United States Patent [19]

Sudrabin et al.

[11] Patent Number: 4,457,821

[45] Date of Patent: Jul. 3, 1984

[54] CATHODIC PROTECTION APPARATUS FOR WELL COATED METAL VESSELS HAVING A GROSS BARE AREA

[75] Inventors: Leon P. Sudrabin, Berkeley Heights; Paul Kaiser, Union, both of N.J.

[73] Assignee: Pennwalt Corporation, Philadelphia, Pa.

[21] Appl. No.: 458,390

[22] Filed: Jan. 17, 1983

[51] Int. Cl.[3] ..... C23F 13/00

[52] U.S. Cl. ..... 204/196; 204/197; 204/284

[58] Field of Search ..... 204/147, 148, 196, 197, 204/284

[56] References Cited

U.S. PATENT DOCUMENTS

| | | | |
|---|---|---|---|
| 2,193,667 | 3/1940 | Bary | 204/196 |
| 2,710,833 | 6/1955 | Craver | 204/196 |
| 2,878,173 | 3/1959 | Obermann | 204/196 |
| 2,941,935 | 6/1960 | Miller et al. | 204/196 |
| 3,425,921 | 2/1969 | Sudrabin | 204/196 |
| 3,620,951 | 11/1971 | Bremerman | 204/196 |
| 3,671,415 | 6/1972 | King et al. | 204/290 F |
| 3,691,040 | 9/1972 | Sudrabin et al. | 204/196 |
| 3,953,311 | 4/1976 | Wasson | 204/197 |
| 4,113,600 | 9/1978 | Cook | 204/197 |

*Primary Examiner*—T. Tung

[57] ABSTRACT

Cathodic protection apparatus employs a grid-type or rod-type anode secured within an electrically insulating tube disposed within an inlet-outlet pipe entering the vessel, the pipe comprising the gross bare area. The vessel is well coated but yet contains minute flaws or bare areas to expose underlying metal, typically steel, to the corroding electrolyte, typically water, contained within the vessel. By maintaining a negative vessel-to-water potential between 0.85 and 1.10 volts as measured between the well coated vessel surface and a saturated copper-copper sulfate reference electrode placed in the water adjacent the coated vessel surface, good corrosion control at the minute flaws is readily effected.

10 Claims, 9 Drawing Figures

CATHODIC PROTECTION APPARATUS FOR WELL COATED METAL VESSELS HAVING A GROSS BARE AREA

STATEMENT OF THE INVENTION

This invention relates to corrosion prevention systems and more particularly to apparatus for cathodically protecting well coated surfaces of metal vessels containing a corroding electrolyte therein.

BACKGROUND AND SUMMARY OF THE INVENTION

Interior or containing surfaces of water storage tanks are generally coated with an electrically resistant material, typically epoxies, vinyls, chlorinated rubbers, coal tar enamels, and the like, to retard or prevent corrosion of the tank metal, typically steel, but not limited thereto. The tank is provided with an inlet-outlet pipe, usually disposed at the floor of the tank, or the tank may be provided with separate inlet and outlet pipes. The interior surface of the pipe is uncoated. The tank coatings, even though carefully applied to provide a well coated surface, contain pores and minute flaws allowing the corroding electrolyte occasional contact with very small areas of the underlying metal surfaces.

The water in the tank is relatively quiescent. The water in the throat of the bare inlet-outlet pipe however is frequently flowing at a high velocity, thus leading to the formation of a differential aeration galvanic corrosion cell between the bare pipe (cathodic) and any metal exposed to the quiescent water at a pore or minute coating flaw (anodic) in the submerged surfaces. The differential aeration galvanic corrosion cell promotes corrosion at these pores and minute flaws which accelerates coating breakdown and further coating failure. The larger cathodic area of the uncoated or bare inlet-outlet pipe, metallically coupled to the relatively small total anodic area of the metal exposed at the pores and minute flaws of the coated surfaces, intensifies the corrosion of the metal at these pores and minute flaws.

At the present time, cathodic protection current is applied to prevent corrosion of well coated tanks by either of two known methods. In one, the protective current is applied from an anode, or anodes suspended in the corroding electrolyte, typically water, with manually or automatically regulated applied current to achieve the desired tank-to-water potential with respect to a reference electrode positioned on the coated tank surface below the surface of the water. The tank-to-water potential however rapidly becomes less electronegative with respect to the positioned reference electrode as the bare area of the inlet-outlet pipe is approached due to potential or IR drop of the applied current as it enters the constricted water conductive path to the gross bare area. Thus, potentials regulated to provide adequate corrosion protection and yet not deteriorate the coating over most of the tank surface due to an excessively high electronegative potential will now always provide the necessary protection to the coated surfaces and flaws thereunder approaching the bare inlet-outlet pipe. To clarity, a negative (cathodic) tank-to-water potential of at least 0.85 volts, as measured between the coated tank surface, typically steel, and a saturated copper-copper sulfate reference electrode placed in the water adjacent the coated steel surface, is desired in order to achieve good corrosion control at the coating flaws and to obtain maximum coating life.

Thus, a higher protective current must be applied to compensate for the aforementioned IR drop which causes the electronegative potential to exceed 1.10 volts, resulting in coating deterioration by electro-endosmotic effects and disbonding by alkali attack.

In a second method, the protective current, applied from the suspended anode or anodes (vertically hung or ring anodes) is regulated to maintain a selected polarized potential free of IR drop. The polarized potential measured when the protective current is momentarily interrupted eliminates the IR drop caused by the applied current flow through the electrolyte from points on the coated surface to the bare areas to which the protective current flows. Similarly, the "null" bridge circuit method, described in U.S. Pat. No. 3,425,921 to Sudrabin, a co-inventor named herein, eliminates the abovediscussed IR drop. The uncoated throat of the inlet-outlet pipe presents the dominant bare area in the system. The resistance of this bare area surface to the electrolyte is usually many times less than the resistance of the entire area of the pinhole flaws of the well-coated tank. Thus, in accordance with the "law of shunts," most of the protective current will flow onto the bare pipe surface. When the protective current is again applied, the IR drop eliminated in the potential measurement due to its momentary interruption, for example, will actually be included in the voltage measurement between the vessel and the reference electrode positioned in the electrolyte at the coated surface.

In well-coated tanks such as those contemplated for cathodic protection by the apparatus of the present invention, the voltage measured across the coating and the underlying metal often exceeds −2.0 volts when one of the IR drop-free control methods abovementioned was employed, which negative voltage is considerably more negative than the desired or optimum value of −0.85 volts or even the upper limit tolerable value of −1.10 volts.

The present invention substantially overcomes the deficiencies of the abovedescribed methods employed currently to protect well coated tanks and provides apparatus which maintains an optimum protective potential uniformly on all submerged coated surfaces of the tank, the optimum potential being a negative (cathodic) voltage of at least 0.85 volts as measured between the coated steel tank surface and a saturated copper-copper sulfate reference electrode in contact with the electrolyte placed adjacent any point on the submerged coating surface. Cathodic protection is controlled to limit the electronegative protective potential to 1.10 volts to retard coating damage. As well coated tank will include at least one gross bare area such as uncoated inlet-outlet pipe, the gross bare area being considerably greater, say 100 times, than the area of any individual flaw in the coating, the gross bare area, extending two pipe diameters into the bare pipe, being greater than 5 times the total bare area of the randomly located coating pores and flaws.

By practicing the present invention, the electrically resistant coating life is maximized. By positioning the anodes in accordance with the present invention, the anodes will be less subjected to damage by ice formation.

DETAILED DESCRIPTION OF THE DRAWINGS

Figure 2:
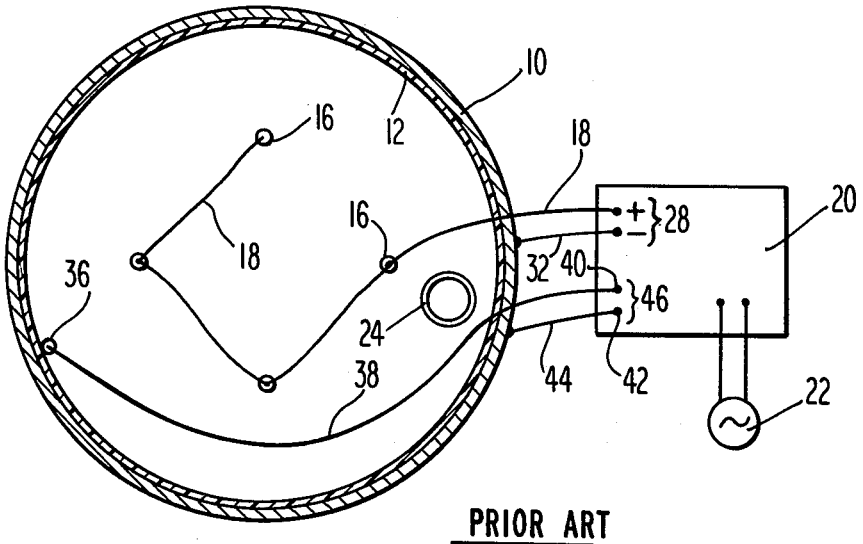
PRIOR ART Fig. 2
FIG. 2 is a sectional view of FIG. 1 taken along line 2—2 thereof.
Figure 1:
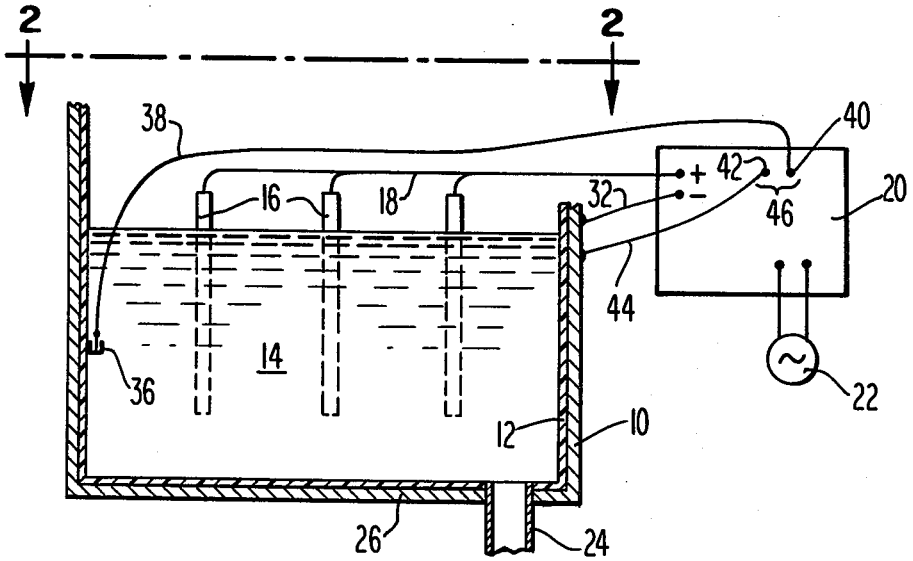
PRIOR ART Fig. 1
FIG. 1 is a sectional view of a metal storage tank, vented roof omitted for purposes of clarity, schematically illustrating prior art cathodic protection apparatus employed with the tank.

In the Figures wherein like numerals throughout represent like components, and referring to FIGS. 1 and 2, storage tank 10, typically steel, is coated on its interior surface with an electrically resistance material 12. Tank 10 stores a corroding electrolyte 14, typically water. A plurality of anodes 16 is suspended vertically from a tank roof (not shown) and are shown connected serially by insulated wires 18 to the positive direct current terminal of a rectifier 20 which converts alternating current from alternating current source 22 to direct current. Rectifier 20 is suitably a potential control rectifier. It is appreciated that anodes 16 may be connected in parallel, and a greater or lesser number than the four anodes shown may be employed.

A bare or uncoated inlet-outlet pipe 24 is provided at the bottom 26 of tank 10.

The protective current circuit 28 of rectifier 20 includes the positive direct current terminal and the negative direct current terminal, the latter being connected to the tank 10, or vessel structure, through lead wire 32.

A saturated copper-copper sulfate reference electrode 36 is disposed adjacent coated surface 12 in known manner and is connected by insulated lead wire 38 to reference electrode terminal 40 of rectifier 20. The structure terminal 42 is connected to tank 10 through lead wire 44. The circuit through terminals 40 and 42 comprises control circuit 46. As is well known, direct current is passed through the electrolyte 14 from anodes 16 immersed therein to the metal structure to be protected which is connected to the negative terminal of the protective current circuit 28 to thereby maintain the necessary negative polarization potential at the structure surface to prevent or retard corrosion thereat. Control circuit 46 controls the current applied to the protective current circuit by well known means.

The prior art apparatus of FIGS. 1 and 2 is suitable for cathodically protecting structures when the coating system thereof has deteriorated to the extent where it no longer exhibits high resistance.

Figure 4:
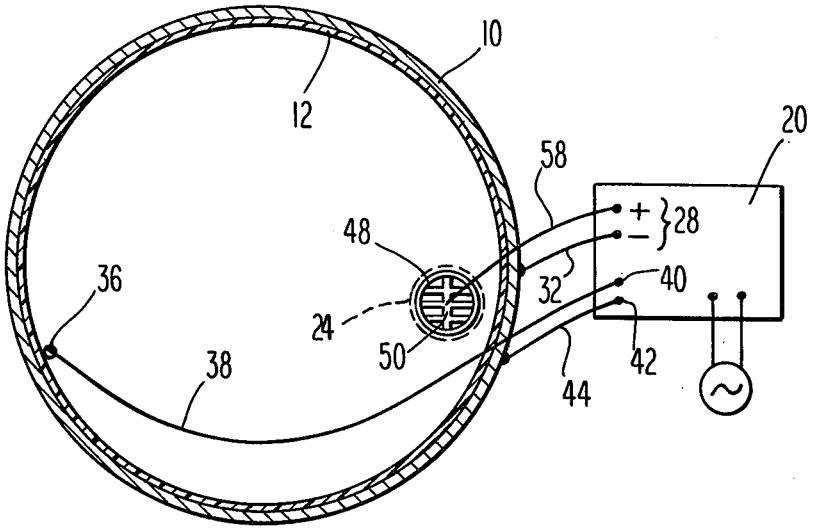
FIG. 4 is a sectional view of FIG. 3 taken along line 4—4 thereof.
Figure 3:
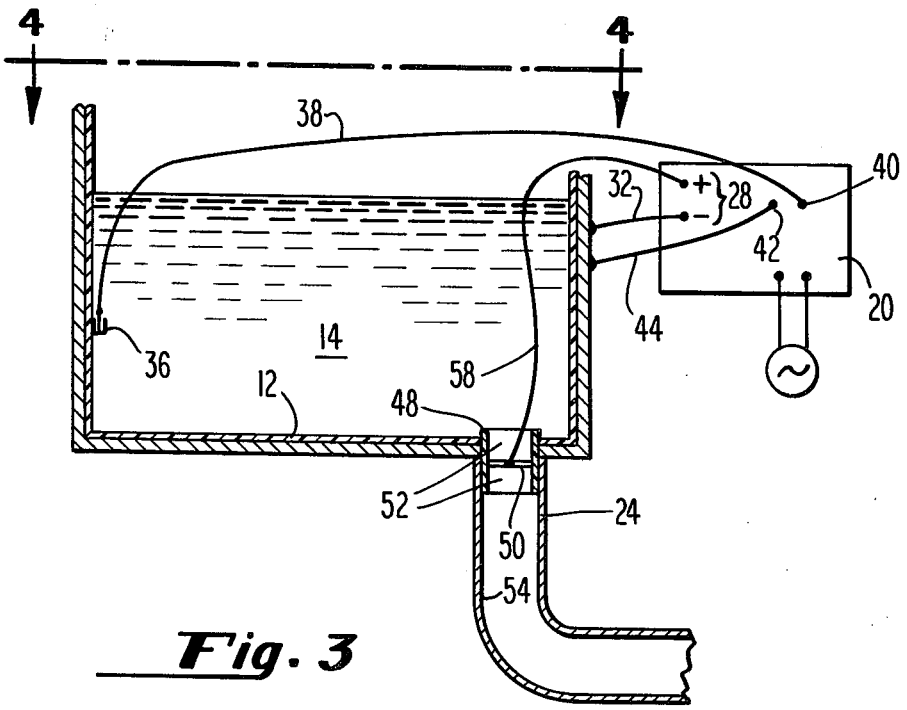
FIG. 3 is a sectional view of a metal storage tank, vented roof omitted, illustrating schematically the device of the present invention for cathodic protection of the tank.

Referring now to FIGS. 3 and 4, inlet-outlet pipe 24 receives a tubular insulator 48 therewithin, typically plastic or porcelain and the like, into which is press fitted, cemented, fastened, suspended, or otherwise suitably mounted, an anode member 50. Tubular insulator 48 extends slightly into tank 10 and defines a column 52 of electrolyte common with the bulk of electrolyte 14 within tank 10. The column of electrolyte 52 provides a confined conductive path of electrolyte tending to provide an uniform voltage field entering the tank, and a resistance which limits the flow of protective current to the gross bare area 54 of pipe 24. Lengthening column 52 by increasing the length of tubular insulator 48 results in reducing the flow of protective current to bare area 54.

Anode 50 is shaped in the form of a grid (FIG. 4) to minimize resistance to fluid flow. Anode 50 is disposed between bare area 54 and coating 12. When employed as a sacrificial galvanic type anode, anode 50 may be made from zinc, magnesium, or aluminum, for example. If impressed current cathodic protection is applied to anode 50, a non-sacrificial material such as platinized (niobium, niobium-copper or titanium) cored wire, high silicon cast iron, iron oxide, or graphite, or other suitable material may be used. Anode 50 is connected by insulated lead wire 58 to the positive terminal of protective current circuit 28 of rectifier 20 in an impressed current cathodic protection system, as shown. When anode 50 is used sacrifically as in a galvanic system, lead wire 58 is connected directly to steel tank 10.

Reference electrode 36 communicates with rectifier 20 by insulated lead wire 38. Reference electrode 36 senses the voltage between it and tank 10 to automatically regulate the applied current from protective current circuit 28 to maintain a desired negative preselected polarization potential at the tank or coated surface.

Figure 5:
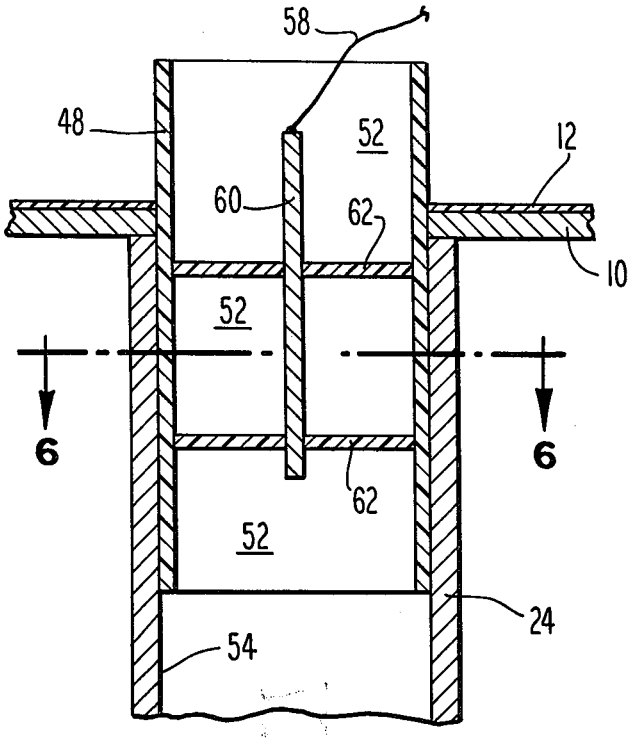
FIG. 5 is a fragmentary sectional view of modified anode structure and position in accordance with the present invention.
Figure 6:
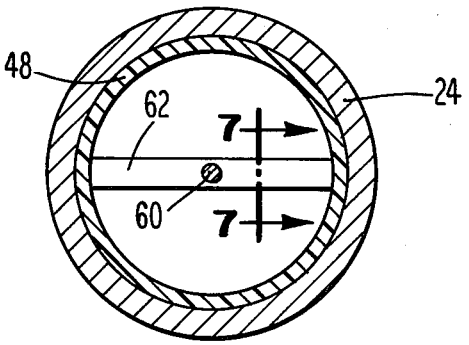
FIGS. 6 and 7 are sectional views taken along lines 6—6 and 7—7 respectively of FIGS. 5 and 6.
Figure 7:
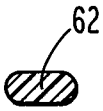

In FIGS. 5 and 6, a rod-type anode 60 is secured axially within tubular insulator 48 by means of a pair of spaced transversely mounted insulating rods or bars 62, configured to minimize resistance to fluid flow, typically as shown in FIG. 7. As abovediscussed, the length of the conductive electrolyte column 52 may be increased to lessen the protective current flow to bare area 54. Insulated lead wire 58 connects anode 60 to the positive terminal of rectifier 20 in an impressed current system and to tank 10 in a galvanic system. Rod anode 60 may be fabricated from the sacrificial and non-sacrificial materials mentioned above for the respective systems.

Figure 9:
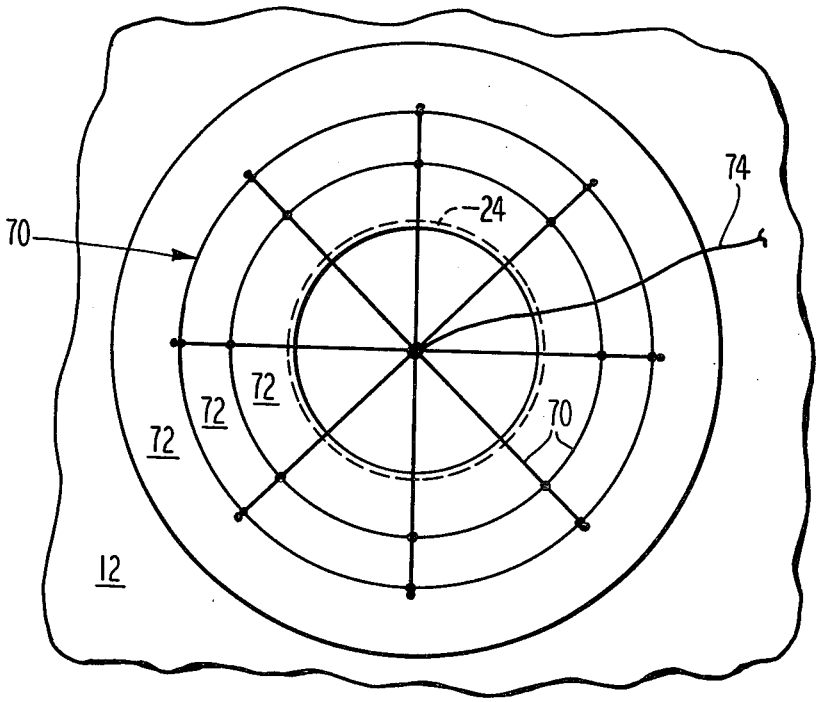
FIG. 9 is a plan view of the modified anode structure of FIG. 8.
Figure 8:
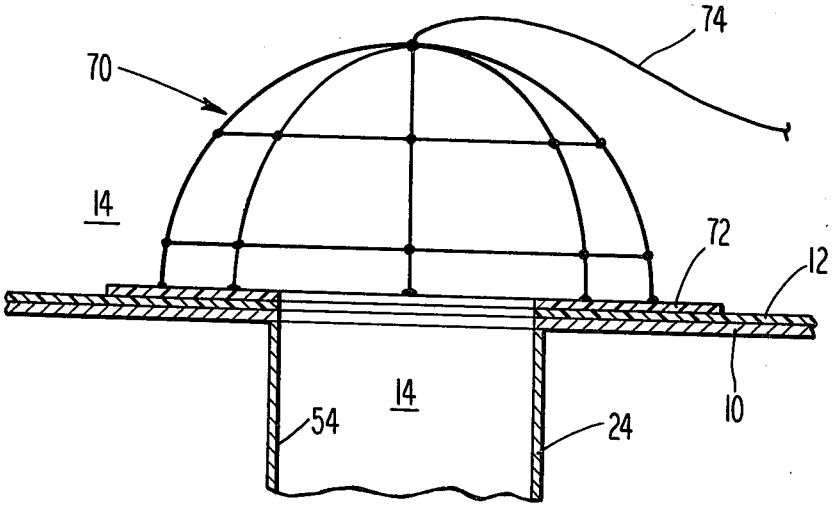
FIG. 8 is a fragmentary sectional view of another modified anode structure and position in accordance with the present invention.

In FIGS. 8 and 9, an hemispherical cage-type anode 70 is positioned atop an annulus 72 of electrically insulating material, centrally affixed above the opening to inlet-outlet pipe 24. Anode 70 is connected by lead wire 74 to the rectifier or vessel depending upon the cathodic protection system employed.

Anode 70 may be constructed from platinized or ruthenium oxide clad niobium or titanium wire or rod, high silicon cast iron or other suitable anode materials.

Anode 70 may be assembled from wire or rod segments and introduced into tank or vessel 10 through a suitable manhole opening, or reassembled or unfolded within vessel 10 and then positioned on annulus 72 as shown.

Anode 70 provides the required cathodic protection current source with a minimal resistance to electrolyte flow. Anode 70 may be increased in size, thereby reducing its electrical resistance to the electrolyte and lessening the voltage needed to obtain the required protective current flow to protect the submerged coated vessel surfaces. The reduced anode voltage to the vessel through the electrolyte minimizes the voltages exerted across the coating in the immediate vicinity of the anode 70 outside annulus 72.

The flow and turbulence of water (electrolyte) through the inlet-outlet pipe provides an ice-free location for anode 70 within the coated vessel.

Regardless of the type anode employed, i.e. grid-type anode 50, rod-type anode 60, or cage-type anode 70, when circular bare areas of tank 10 were exposed, each of said bare areas comprising up to one percent (1%) of the gross bare area 54 of the pipe 24, but not exceeding about 20%, and a protective current regulated to achieve a tank voltage of −0.85 volts to a saturated copper-copper sulfate reference electrode positioned in the tank as aforediscussed, each of the bare areas approached the optimum voltage of −0.85 volts within a period of 45 minutes. The voltage at several of these bare areas was measured against a stylus tipped reference electrode placed at the center of the bare areas in order to minimize the potential or IR drop while protective current was applied. The current density received by each of the circular bare areas was about 10 times greater than the current density received by the gross bare area. Thus, if the protective voltage, or a slightly more negative vessel voltage, but not exceeding −1.10 volts, to a saturated copper-copper sulfate reference electrode is maintained in the bulk of the water, corrosion at these bare areas and flaws in the well coated tank will effectively be controlled.

We claim:

1. Cathodic protection apparatus for a metal vessel containing a corroding electrolyte therein, said vessel having a well coated containing surface and at least one gross bare area in direct metallic contact with said metallic vessel, said gross bare area defining a confined conductive path for said electrolyte, said apparatus comprising an uncoated inlet-outlet pipe defining said gross bare area, said well coated containing surface including minute pores and flaws to expose underlying vessel metal to said electrolyte, said gross bare area being greater than at least about 5 times the total bare area of said minute pores and flaws, a tubular electrical insulator of non-metallic material received within said inlet-outlet pipe, an anode centrally disposed within said tubular insulator and electrically insulated from said vessel and said inlet-outlet pipe, rectifier means disposed exteriorly of said vessel for supplying direct current to said anode for providing a protective current circuit to said vessel, a saturated copper-copper sulfate reference electrode disposed adjacent said well coated surface and within said electrolyte for regulating said protective current circuit with said rectifier means, said direct current from said rectifier means impressed upon said anode whereby an electronegative vessel-to-electrolyte potential as measured between said well coated surface and said reference electrode is maintained between about 0.85 and 1.10 volts.

2. Apparatus of claim 1 wherein said metal vessel is a storage tank and said electrolyte is water.

3. Apparatus of claim 2 wherein said storage tank is steel and said inlet-outlet pipe is disposed at or adjacent a floor portion of said tank.

4. Apparatus of claim 3 wherein said anode is configured to resemble a grid and offer minimum resistance to fluid flow.

5. Apparatus of claim 3 wherein said anode is configured to resemble a rod and offer minimum resistance to fluid flow.

6. Cathodic protection apparatus for a metal tank containing a corroding electrolyte therein, said tank having a well coated containing surface and at least one gross bare area in direct metallic contact with said metallic tank, said gross bare area defining a confined conductive path for ingress and egress of said electrolyte to and from said tank respectively, said well coated surface including minute pores and flaws to expose underlying tank metal to said electrolyte, each of said minute pores and flaws not exceeding 1% of said gross bare area, said underlying tank metal exposed by said minute pores and flaws having a total area not exceeding 20% of total area of said gross bare area, said apparatus comprising an uncoated inlet-outlet pipe defining said gross bare area, said pipe disposed at or adjacent a bottom portion of said tank, a tubular electrical insulator received within said pipe, said insulator defining a column of electrolyte in communication with said electrolyte contained within said tank, an anode disposed centrally within said insulator, rectifier means disposed exteriorly said tank for supplying direct current to said anode for providing a protective current circuit to said vessel, a saturated copper-copper sulfate reference electrode disposed adjacent said well coated surface and within said electrolyte for controlling said protective current circuit with said rectifier means, said direct current from said rectifier means impressed upon said anode whereby an electronegative tank-to-electrolyte potential as measured between said well coated surface and said reference electrode is maintained between about 0.85 and 1.10 volts, said column of electrolyte having a length defined by length of said insulator, said column of electrolyte limiting flow of said current to said gross bare area and to said minute pores and flaws in said well coated surface.

7. Apparatus of claim 6 wherein said underlying tank metal of any coating flaw constituting about 1% of said gross bare area receives about 10 times the current density received by said gross bare area to thereby control corrosion at said underlying metal surfaces.

8. Cathodic protection apparatus for a metal vessel containing a corroding electrolyte therein, said vessel having a well coated containing surface and at least one gross bare area in direct metallic contact with said metallic vessel, said gross bare area defining a confined conductive path for said electrolyte, said apparatus comprising an anode disposed immediately above said gross bare area and between said vessel well coated surface and said gross bare area, an electrically insulating annulus secured centrally over said gross bare area on said coated surface adjacent thereto, said anode centrally mounted atop said annulus, rectifier means disposed exteriorly said vessel for supplying direct current to said anode for providing a protective current circuit to said vessel, a saturated copper-copper sulfate reference electrode disposed adjacent said well coated surface and within said electrolyte for controlling said protective current circuit with said rectifier means, said direct current from said rectifier means impressed upon said anode whereby an electronegative vessel-to-electrolyte potential as measured between said well coated surface and said reference electrode is maintained about 0.85 and 1.10 volts.

9. Apparatus of claim 8 wherein said anode is configured to resemble an hemispherical cage and offering minimum resistance to fluid flow therethrough.

10. Cathodic protection apparatus for a metal vessel containing a corroding electrolyte therein, said vessel having a well coated containing surface and at least one gross bare area in direct metallic contact with said metallic vessel, said gross bare area defining a confined conductive path for said electrolyte, said apparatus comprising an uncoated inlet-outlet pipe defining said gross bare area, said well coated containing surface including minute pores and flaws to expose underlying vessel metal to said electrolyte, said gross bare area being greater than at least about 5 times the total bare area of said minute pores and flaws, a galvanic anode centrally disposed within a tubular electrical insulator of non-metallic material received within said inlet-outlet pipe and in said conductive path, said galvanic anode metallically coupled to said vessel providing protective current thereto, a saturated copper-copper sulfate reference electrode disposed adjacent said well coated surface and within said electrolyte, and means connected to said reference electrode for indicating potential of said vessel resulting from said protective current applied thereto.

* * * * *